US009283780B2

(12) United States Patent
Iizuka et al.

(10) Patent No.: US 9,283,780 B2
(45) Date of Patent: Mar. 15, 2016

(54) PRINTER AND METHOD FOR CONTROLLING PRINTER

(71) Applicant: FUJITSU COMPONENT LIMITED, Tokyo (JP)

(72) Inventors: Hisamitsu Iizuka, Tokyo (JP); Sumio Watanabe, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/572,971

(22) Filed: Dec. 17, 2014

(65) Prior Publication Data

US 2015/0183241 A1 Jul. 2, 2015

(30) Foreign Application Priority Data

Dec. 26, 2013 (JP) ..... 2013-269260

(51) Int. Cl.
*B41J 29/38* (2006.01)
*B41J 29/393* (2006.01)
*B41J 11/04* (2006.01)

(52) U.S. Cl.
CPC ..... *B41J 11/04* (2013.01)

(58) Field of Classification Search
USPC ..... 347/16, 19
See application file for complete search history.

(56) References Cited

U.S. PATENT DOCUMENTS 5,150,129 A * 9/1992 Hara et al. ..... 347/9
2002/0021927 A1* 2/2002 Mori et al. ..... 400/120.01

FOREIGN PATENT DOCUMENTS

| | | |
|---|---|---|
| EP | 2353875 | 8/2011 |
| JP | H10-250130 | 9/1998 |
| JP | 2004-210444 | 7/2004 |
| JP | 2008-030253 | 2/2008 |

* cited by examiner

*Primary Examiner* — Jason Uhlenhake
(74) *Attorney, Agent, or Firm* — IPUSA, PLLC

(57) ABSTRACT

A printer includes a platen roller, a print head for performing printing on a recording paper, a first detection switch and a second detection switch for detecting a position of the platen roller, and a potential detector that detects electrical potential. Both of the first and second detection switch are switched off when the platen roller is mounted, and switched on when the platen roller is not mounted. One terminal of the first detection switch and one terminal of the second detection switch are connected to each other in parallel and grounded via a ground side resistor. A power supply is to be connected to another terminal of the first detection switch and another terminal of the second detection switch. The potential detector detects a potential between the one terminals of the first and second detection switches and the ground side resistor.

9 Claims, 6 Drawing Sheets

| | | FIRST SWITCH 32 | |
|---|---|---|---|
| | | ON | OFF |
| SECOND SWITCH 42 | ON | L | H |
| | OFF | H | H |

| | | FIRST SWITCH 132 | |
|---|---|---|---|
| | | ON | OFF |
| SECOND SWITCH 142 | ON | L | L |
| | OFF | L | H |

| | | FIRST SWITCH 132 | |
|---|---|---|---|
| | | ON | OFF |
| SECOND SWITCH 142 | ON | $V_1$ | $V_2$ |
| | OFF | $V_3$ | 0V |

FIG.9

| RESISTOR | RESISTANCE VALUE (kΩ) |
|---|---|
| R11 | 0.75 |
| R21 | 1.2 |
| R12 | 0.47 |
| R22 | 1.2 |

FIG.10

| | POTENTIAL (V) |
|---|---|
| $V_1$ | 1.9 |
| $V_2$ | 1.6 |
| $V_3$ | 1.2 |
| 0V | 0.0 |

$Vt_2$ $Vt_3$ $Vt_1$

PRINTER AND METHOD FOR CONTROLLING PRINTER

CROSS-REFERENCE TO RELATED APPLICATIONS

This application is based upon and claims the benefit of priority of the prior Japanese Patent Application No. 2013-269260 filed on Dec. 26, 2013, the entire contents of which are incorporated herein by reference.

FIELD

The embodiments discussed herein are related to a printer and a method for controlling the printer.

BACKGROUND

A printer for outputting a receipt or the like is widely used for various purposes such as a cashier terminal of a shop or an ATM (Automated Teller Machine) or a cash dispenser of a bank. For example, a printer outputs a receipt by printing characters or the like on a recording paper (e.g., heat sensitive paper) with a thermal head while conveying the recording paper, and cutting the recording paper upon reaching the predetermined length.

The printer includes, for example, a printer body and a cover rotatably supported by the printer body. By opening the cover, a roll of recording paper can be placed into the printer body. A thermal head may be placed in the printer body, and a platen roller may be placed in the cover. By closing the cover, the recording paper can be sandwiched between the thermal head and the platen roller. In this state where the recording paper is sandwiched between the thermal head and the platen roller, printing by the thermal head is performed. A small-sized easy-to-carry mobile printer is an example of the printer using the thermal head or the like.

[Patent Document 1]: Japanese Laid-Open Patent Publication No.: 10-250130

[Patent Document 2]: Japanese Laid-Open Patent Publication No. 2004-210444

[Patent Document 3]: Japanese Laid-Open Patent Publication No. 2008-30253

With a printer using a thermal head or the like, the printer takes a printable state by closing the lid. Whether the printer is in the printable state or not may be determined by determining whether the platen roller is in a predetermined position while the lid is closed.

More specifically, a printer 100 illustrated in FIG. 1 includes a thermal head 10. Further, the printer 100 has a platen guide 30 and a platen guide 40 provided on each of its ends for mounting a platen roller 20 thereon. The platen roller 20 is mounted to the printer by rotatably fixing the ends of the platen roller 20 to the platen guides 30, 40. The printer 100 also includes a motor 51 for conveying a recording paper by rotating the platen roller 20 and a gear box 52 for transmitting the rotation of the motor 51 to the platen roller 20.

Further, a platen lock lever 31 for retaining the platen roller 20 is rotatably joined to the platen guide 30. The platen guide 30 also includes a detection switch 32 for detecting whether the platen roller 20 is mounted in a predetermined position according to the position of the platen lock lever 31.

Similarly, a platen lock lever 41 for retaining the platen roller 20 is rotatably joined to the platen guide 40. The platen guide 40 also includes a detection switch 42 for detecting whether the platen roller 20 is mounted in a predetermined position according to the position of the platen lock lever 41.

In the example of FIG. 1, a position detection switch may be used for each of the first and second detection switches 32, 42. The position detection switch is a mechanical switch that is switched on when pressure is exerted thereto and switched off when pressure is no longer exerted thereto. That is, a normal open type detection switch may be used for each of the first and second detection switches 32, 42. More specifically, the platen roller 20 is retained at a predetermined position by the platen lock levers 31, 41 when a cover (not illustrated) is closed. When the cover is closed, the platen lock lever 31, 41 are moved to press the first and second detection switches 32, 42. Thereby, the first and second detection switches 32, 42 are switched on. Further, when the platen roller 20 is disengaged from the platen guides 30, 40 by opening the cover, the platen lock levers 31, 41 return to their initial positions. Because the platen lock levers 31, 41 no longer exert pressure to the first and second detection switches 32, 42, the first and second detection switches 32, 42 are released from the pressure and switched off.

In a case of detecting whether the platen roller 20 is mounted in a predetermined position by using the first and second detection switches 32, 42, a circuit having the first and second detection switches 32, 42 connected in series is used (see FIG. 2). More specifically, one end of the second detection switch 42 is grounded, the other end of the second detection switch 42 is connected to one end of the first detection switch 32, and the other end of the first detection switch 32 is connected to a resistor 60. Accordingly, potential is applied from a power supply Vcc to the first and second detection switches 32, 42 via the resistor 60. The detection of the platen roller 20 is performed by a potential detector 71 that detects the potential between the other terminal of the first detection switch 32 and the resistor 60.

In a case where the platen roller 20 is mounted in a predetermined position by the closing of the cover (not illustrated), the first and second detection switches 32, 42 are both switched on. Therefore, the potential detected by the potential detector 71 is low (0 V) as illustrated in FIG. 3. In a case where the platen roller 20 is disengaged from the predetermined position by the opening of the cover (not illustrated), the first and second detection switches 32, 42 are both switched off. Therefore, the potential detected by the potential detector 71 is high (Vcc) as illustrated in FIG. 3.

In a case where one of the first and second detection switches 32, 42 is switched on and the other is switched off, the potential detected by the potential detector 71 is high. This case may apply to, for example, a situation where one end of the platen roller 20 is properly mounted to the predetermined position whereas the other end of the platen roller 20 is not properly mounted to the predetermined position, or a situation where there is a malfunction due to a disconnection of one of the first and second detection switches 32, 42. In any of these situations, with the circuit illustrated in FIG. 2, the potential detector 71 detects the platen roller 20 not being mounted in the predetermined position. Therefore, with the circuit illustrated in FIG. 2, the potential detector 71 is unable to determine whether the platen roller 20 is not mounted in the predetermined position or whether there is a malfunction due to a disconnection of one of the first and second detection switches 32, 42.

Further, with the detection method using the circuit of FIG. 2, electric current constantly flows to the first and second detection switches 32, 42 when the platen roller 20 is mounted in the predetermined position in a state where the printer 100 is used. Thus, the first and second detection switches 32, 42 may malfunction due to aged deterioration caused by the constantly flowing current. Further, power consumption becomes large due to the constantly flowing current when the printer 100 is being used. Thus, in a case where the printer 100 is driven by a battery, the timespan for using the printer 100 becomes short.

SUMMARY

According to an aspect of the invention, there is provided a printer including a platen roller, a print head for performing printing on a recording paper, a first detection switch and a second detection switch for detecting a position of the platen roller, and a potential detector that detects electrical potential. Both of the first and second detection switch are switched off when the platen roller is mounted, and switched on when the platen roller is not mounted. One terminal of the first detection switch and one terminal of the second detection switch are connected to each other in parallel and grounded via a ground side resistor. A power supply is to be connected to another terminal of the first detection switch and another terminal of the second detection switch. The potential detector detects a potential between the one terminals of the first and second detection switches and the ground side resistor.

The object and advantages of the invention will be realized and attained by means of the elements and combinations particularly pointed out in the claims.

It is to be understood that both the foregoing general description and the followed detailed description are exemplary and explanatory and are not restrictive of the invention as claimed.

BRIEF DESCRIPTION OF DRAWINGS

FIG. 9 is a table for describing a resistance value of a printer according to a practical example; and FIG. 10 is a table for describing a potential detected by a printer according to a practical example.

DESCRIPTION OF EMBODIMENTS

Figure 1:
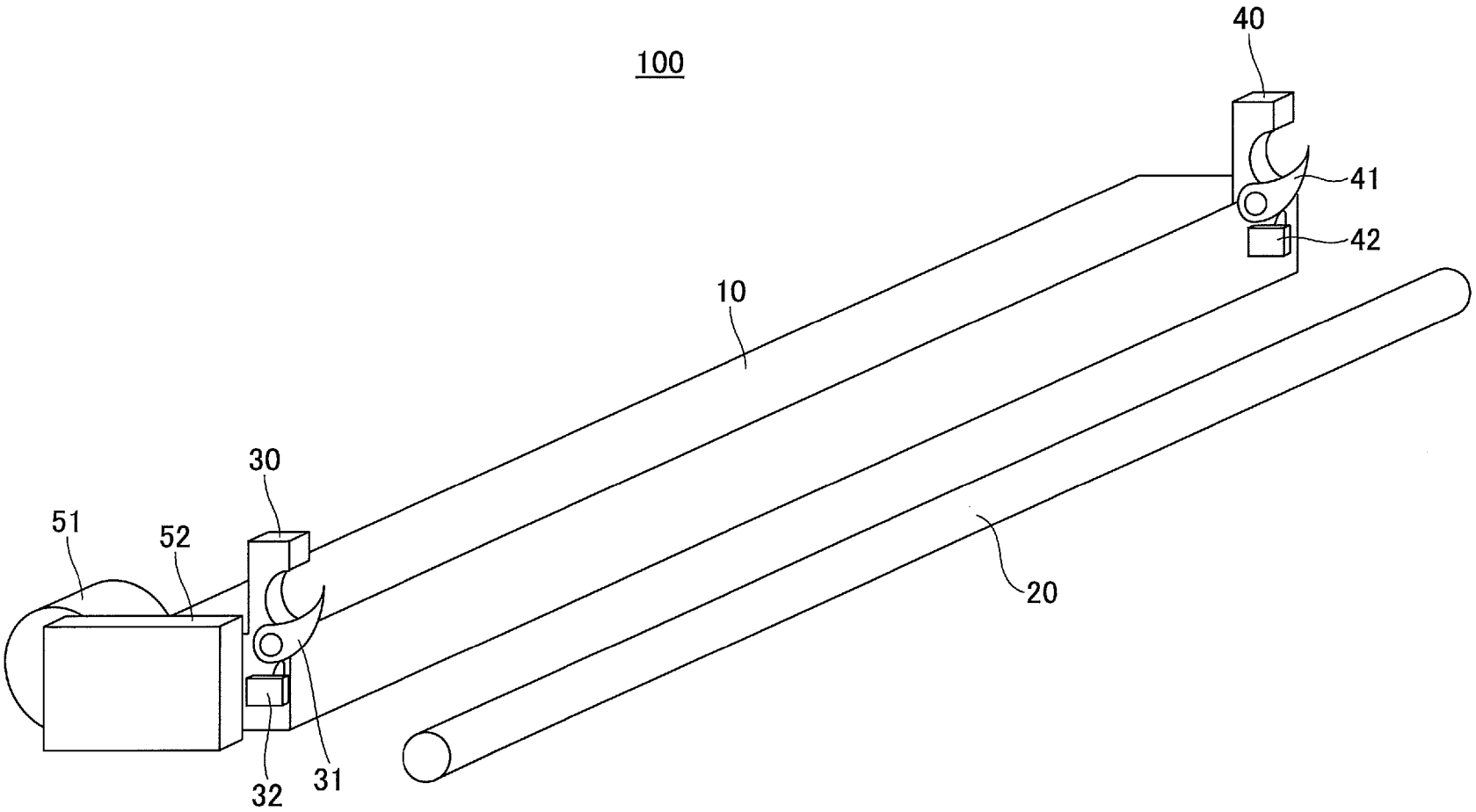
FIG. 1 is a schematic diagram illustrating a structure of a printer.
Figures 2, 3:
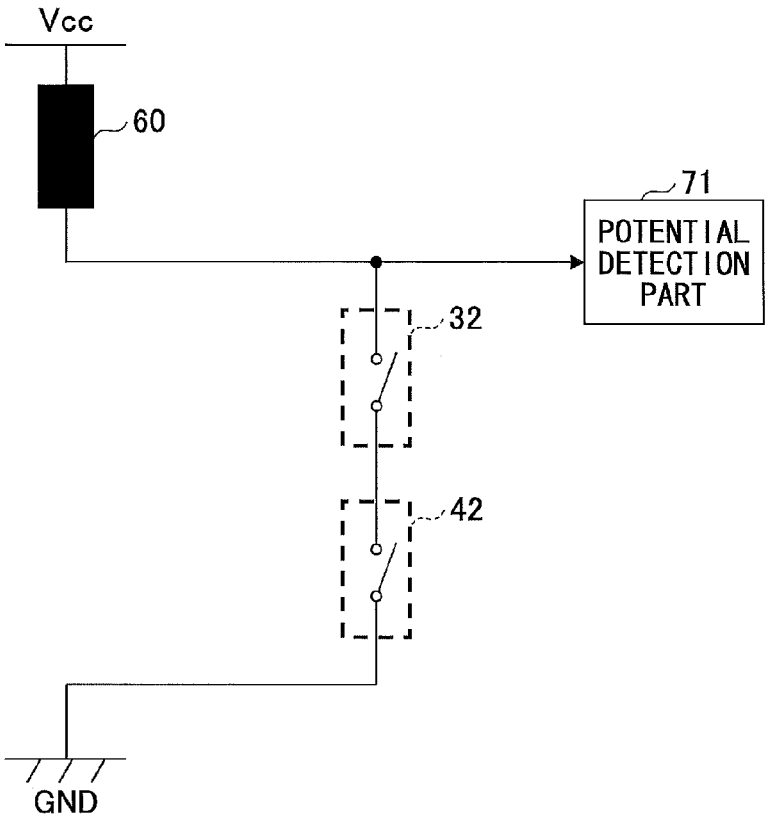
FIG. 2 is a schematic diagram for describing a method for controlling a printer.
FIG. 3 is another schematic diagram for describing the method for controlling a printer.

In the following, embodiments of the present invention are described with reference to the accompanying drawings. Like components are denoted with like reference numerals throughout the following description and are not further explained.

First Embodiment

Figure 4:
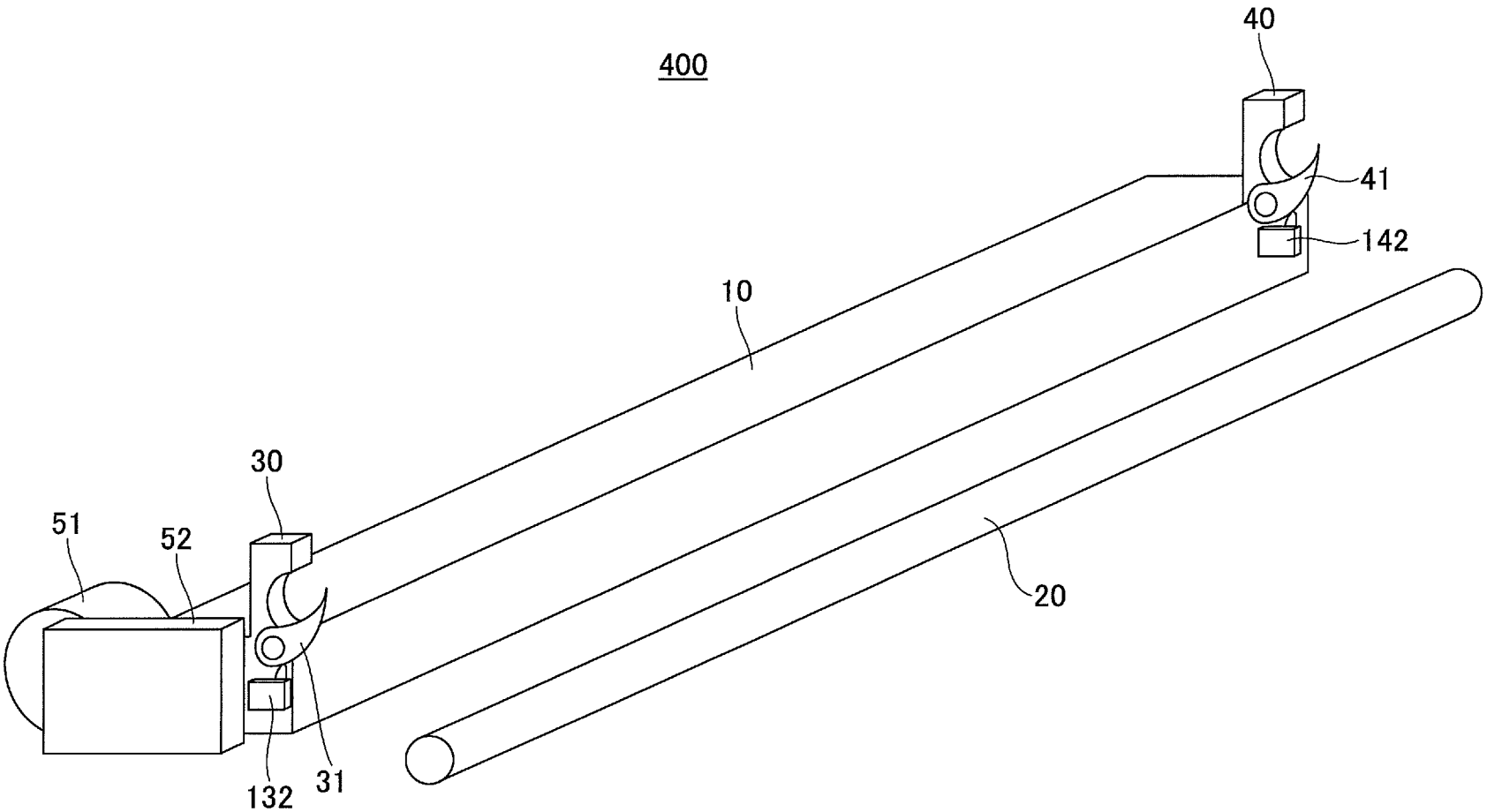
FIG. 4 is a schematic diagram illustrating a structure of a printer according to a first embodiment of the present invention.

A printer 400 according to the first embodiment is described with reference to FIGS. 4-6. As illustrated in FIG. 4, the printer 400 includes a thermal head 10 serving as a printer head, a platen roller 20, a motor 51, and a gear box 52. The gear box 52 is for transmitting the rotation of the motor 51 to the platen roller 20. Accordingly, a recording paper (not illustrated) is conveyed by rotating the platen roller 20 that is rotated by the rotation of the motor 51 via the gear box 52.

In the first embodiment, one of the thermal head 10 and the platen roller 20 is mounted to a printer body of the printer 400 and the other is mounted to a cover of the printer 400. The platen roller 20 is placed in a predetermined position when cover is closed. The printer 400 has two platen guides, a platen guide 30 and a platen guide 40 provided on each of its ends for mounting the platen roller 20 thereon. The platen roller 20 is mounted to the printer 400 by rotatably fixing the ends of the platen roller 20 to the platen guides 30, 40. In the printer 400 of the first embodiment, the thermal head 10 performs printing on a recording paper such as heat sensitive paper sandwiched between the thermal head 10 and the platen roller 20.

A platen lock lever 31 for retaining the platen roller 20 is rotatably joined to the platen guide 30. Further, a first detection switch 132 is provided in the vicinity of the platen lock lever 31. The first detection switch 132 is for determining whether the platen roller 20 is mounted in a predetermined position by detecting the position of the platen lock lever 31.

Similarly, a platen lock lever 41 for retaining the platen roller 20 is rotatably joined to the platen guide 40. Further, a second detection switch 142 is provided in the vicinity of the platen lock lever 41. The second detection switch 142 is for determining whether the platen roller 20 is mounted in a predetermined position by detecting the position of the platen lock lever 41.

In the first embodiment, a mechanical switch that is switched off when pressure is exerted thereto and switched on when pressure is no longer exerted thereto may be used for each of the first and second detection switches 132, 142. That is, a normally closed type detection switch may be used for each of the first and second detection switches 132, 142. More specifically, the platen roller 20 is retained at a predetermined position by the platen lock levers 31, 41 when the cover is closed. When the cover is closed, each of the platen lock levers 31, 41 moves to press the first detection switch 132 and the second detection switch 142, respectively. Thereby, the first and second detection switches 132, 142 are switched off. On the other hand, when the platen roller 20 is disengaged from the platen guides 30, 40 by opening the cover, the platen lock levers 31, 41 return to their initial positions. Because the platen lock levers 31, 41 no longer exert pressure to the first and second detection switches 132, 142, the first and second detection switches 132, 142 are released from the pressure and switched on.

Figures 5, 6:
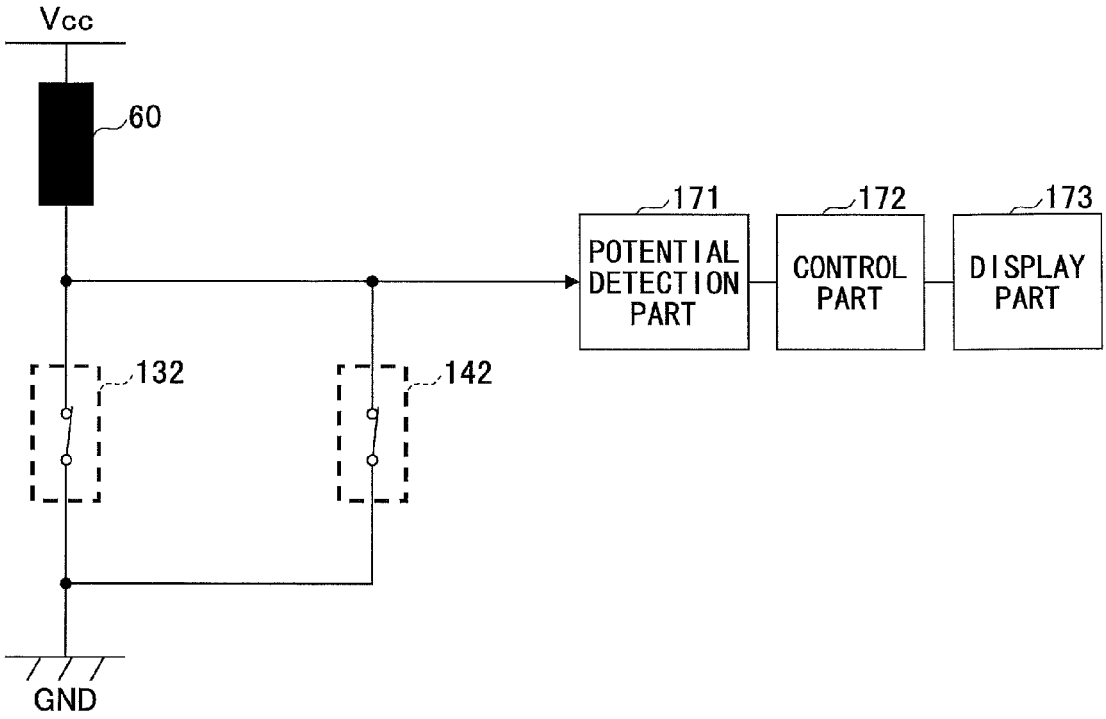
FIG. 5 is a schematic diagram for describing a printer according to the first embodiment of the present invention.
FIG. 6 is a another schematic diagram for describing the method for controlling a printer according to the first embodiment of the present invention.

To detect whether the platen roller 20 is mounted in a predetermined position by using the first and second detection switches 132, 142, a circuit having the first and second detection switches 132, 142 connected in parallel is used (see FIG. 5). More specifically, one end of the first detection switch 132 (terminal on a lower side of FIG. 5) is connected to one end of the second detection switch 142 and is also grounded. The other end of the first detection switch 132 (terminal on an upper side of FIG. 5) is connected to the other end of the second detection switch 142 and is also connected to the resistor 60. Accordingly, potential is applied from the power supply Vcc to the other terminal of the first detection switch 132 and the other terminal of the second detection switch 142 via the resistor 60. The detection of the platen roller 20 is performed by a potential detector 171 that detects the potential between the other terminal of the first detection switch 132 and the resistor 60.

When the platen roller 20 is mounted to the printer 400 in a predetermined position by the closing of the cover, the first and second detection switches 132, 142 are both switched off. Therefore, the potential detected by the potential detector 171 is high (Vcc) as illustrated in FIG. 6. If the platen roller 20 is disengaged when the cover is opened, the first and second detection switches 132, 142 are both switched on. Therefore, the potential detected by the potential detector 171 is low (0 V) as illustrated in FIG. 6.

With the printer 400 of the first embodiment, the potential detector 171 is connected to a connection part that the other terminals of the first and second detection switches 132, 142 and the resistor 60 are connected. The potential detector 171 detects the potential at the connection part between the other terminals of the first and second detections switches 132, 142 and the resistor 60. The potential detector 171 includes, for example, an A/D converter that converts a potential as an analog signal to a digital signal. The potential detector 171 is connected to a control part 172 for performing controls and determining whether the platen roller 20 is mounted in the predetermined position. A display part 173 displays, for example, a mounting state of the platen roller 20 based on the determination by the control part 172. The display part 173 may be a liquid crystal display, an LED (Light Emitting Diode) device or the like.

With the first embodiment, the first and second detection switches 132, 142 are switched off and electric current does not flow when the platen roller 20 is properly mounted to the printer 400 in the predetermined position in a state where the printer 400 is being used. Thus, the first and second detection switches 132, 142 can be prevented from malfunctioning due to aged deterioration caused by a constantly flowing current. Further, power consumption can be reduced because current only flows when the platen roller 20 is disengaged from the predetermined position by the opening of the cover. Thus, even in a case where the printer 400 is driven by a battery, the timespan for using the printer 100 can be increased.

When one of the first and second switch switches 132, 142 is switched on and the other is switched off, the potential to be detected by the potential detector 171 is low. This case may apply to, for example, a situation where one end of the platen roller 20 is properly mounted whereas the other end of the platen roller 20 is not properly mounted to the predetermined position even if the cover is closed, or a situation where there is a malfunction due to a disconnection of one of the first and second detection switches 132, 142. In any of these situations, with the circuit illustrated in FIG. 5, the potential detector 171 detects that the platen roller 20 not being mounted in the predetermined position. Therefore, with the circuit illustrated in FIG. 5, the potential detector 171 is unable to determine whether the platen roller 20 is not mounted in the predetermined position or whether one of the first and second detection switches 132, 142 is disconnected.

Second Embodiment

Next, the second embodiment of the present invention is described. The second embodiment relates to a printer having the same structure as the printer 400 illustrated in FIG. 4.

Figures 7, 8:
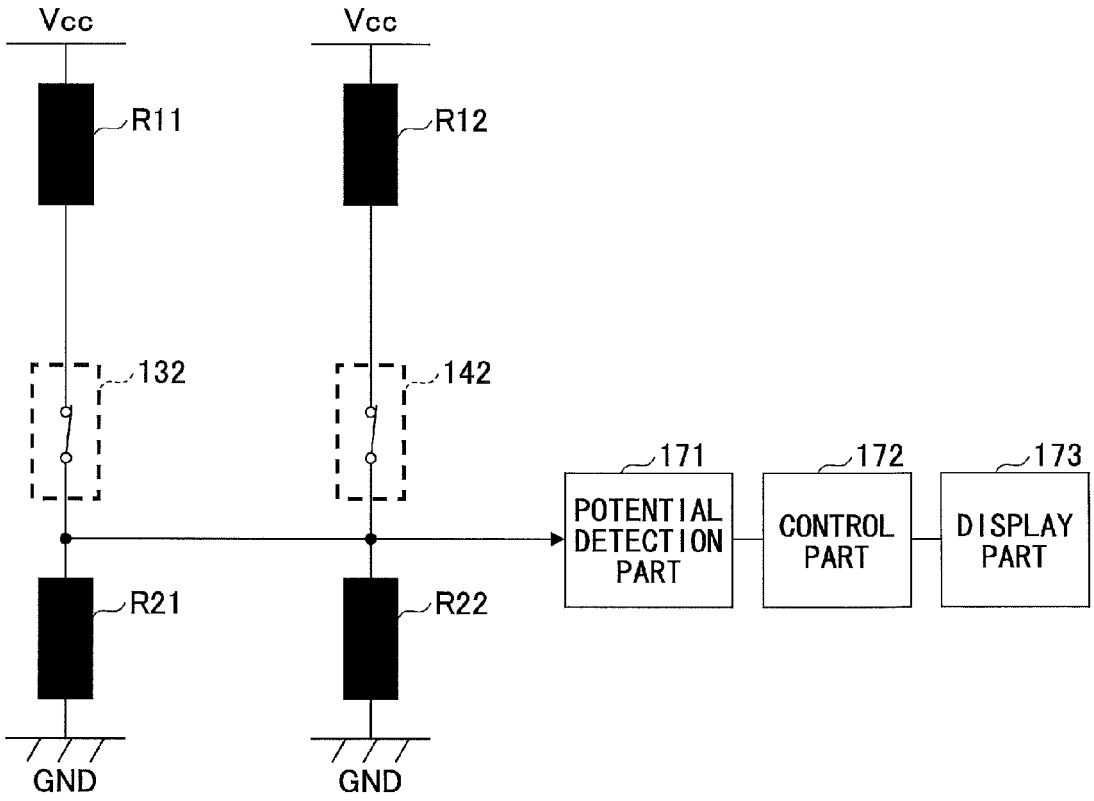
FIG. 7 is a schematic diagram for describing a printer according to a second embodiment of the present invention.
FIG. 8 is a another schematic diagram for describing the method for controlling a printer according to the second embodiment of the present invention.

In the second embodiment, to determine whether the platen roller 20 is mounted in the predetermined position by using the first and second detection switches 132, 142, resistors are connected to the ground side of the first and second detection switches 132, 142 as illustrated in FIG. 7.

More specifically, four resistors R11, R12, R21, and R22 are provided to the printer 400 of the second embodiment. One terminal of the first detection switch 132 is connected to a third resistor R21 and is grounded via the third resistor R21. A first resistor R11 is connected to the other terminal of the first detection switch 132. Thus, the potential of the power supply Vcc is applied to the first detection switch 132 via the first resistor R11. One terminal of the second detection switch 142 is connected to a fourth resistor R22 and is grounded via the fourth resistor R22. The other terminal of the second detection switch 142 is connected to a second resistor R12. Thus, the potential of the power supply Vcc is applied to the second detection switch 142 via the second resistor R12. A connection part between the one terminal of the first detection switch 132 and the third resistor R21 and a connection part between the one terminal of the second detection switch 142 and the fourth resistor R22 are connected to each other. These connection parts are also connected to the potential detector 171.

Next, the determination performed by the control part 172 is described based on FIG. 8. If the platen roller 20 is mounted in a predetermined position when the cover is closed, the first and second detection switches 132, 142 are both switched off. Therefore, the potential detected by the potential detector 171 is 0 V.

If the platen roller 20 is disengaged from the predetermined position when the cover is opened, the first and second detection switches 32, 42 are both switched on. Therefore, the potential detected by the potential detector 171 is $V_1$. The potential $V_1$ is a voltage divided by a combined resistance of the first and second resistors R11, R12 and a combined resistance of the third and fourth resistors R21, R22. The potential $V_1$ can be calculated by the following Expression 1.

$$V_1 = \frac{\dfrac{R_{21} \times R_{22}}{R_{21} + R_{22}}}{\dfrac{R_{11} \times R_{12}}{R_{11} + R_{12}} + \dfrac{R_{21} \times R_{22}}{R_{21} + R_{22}}} \times Vcc \qquad \text{< Expression 1 >}$$

Further, when the first detection switch 132 is disconnected, the potential detected by the potential detector 171 is $V_2$ if the platen roller 20 is disengaged from the predetermined position. The potential $V_2$ is a divided voltage divided by a resistance of the second resistor R12 and a combined resistance of the third and fourth resistors R21, R22. The potential $V_2$ can be calculated by the following Expression 2.

$$V_2 = \frac{\dfrac{R_{21} \times R_{22}}{R_{21} + R_{22}}}{R_{12} + \dfrac{R_{21} \times R_{22}}{R_{21} + R_{22}}} \times Vcc \qquad \text{< Expression 2 >}$$

Further, when the second detection switch 142 is disconnected, the potential detected by the potential detector 171 is $V_3$ if the platen roller 20 is disengaged from the predetermined position. The potential $V_3$ is a divided voltage divided by a resistance of the first resistor R11 and a combined resistance of the third and fourth resistors R21, R22. The potential $V_3$ can be calculated by the following Expression 3.

$$V_3 = \frac{\dfrac{R_{21} \times R_{22}}{R_{21} + R_{22}}}{R_{11} + \dfrac{R_{21} \times R_{22}}{R_{21} + R_{22}}} \times Vcc \qquad \text{< Expression 3 >}$$

If the resistance value of the first resistor R11 and the resistance value of the second resistor R12 are equal, the value of the potential $V_2$ and the value of the potential $V_3$ become equal. Therefore, the relationship of the potentials $V_1$, $V_2$, and $V_3$ is $0V<V_2$ ($V_3$)$<V_1$. Thus, a potential that is between 0 V and $V_2$ ($V_3$) is set as a first threshold $V_{t1}$, and a potential that is between $V_2$ ($V_3$) and $V_1$ is set as a second threshold $V_{t2}$. Accordingly, if the potential detected by the potential detector 171 is lower than the first threshold $V_{t1}$, the control part 172 can determine that the platen roller 20 is mounted in the predetermined position. If the potential detected by the potential detector 171 is higher than the second threshold $V_{t2}$, the control part 172 can determine that the platen roller 20 is not mounted in the predetermined position. Further, when the potential detected by the potential detector 171 is equal to or greater than the first threshold $V_{t1}$ or if the potential detected by the potential detector 171 is equal to or less than the second threshold $V_{t2}$, the control part 172 can determine that there is a malfunction due to a disconnection of the first detection switch 132 or the second detection switch 142. The determination results of the control part 172 are displayed in the display part 173.

Accordingly, with the second embodiment, the control part 172 not only determines whether the platen roller 20 is mounted in the predetermined position but also determines whether there is a malfunction of one of the first and second detection switches 132, 142.

In a case where the resistance value of the first resistor R11 is greater than the resistance value of the second resistor R12 (R11>R12), the relationship of the potentials $V_1$, $V_2$, and $V_3$ is $0V<V_3<V_2<V_1$. In this case, a potential between $V_2$ and $V_3$ is set to be a third threshold $V_{t3}$. Accordingly, in a case where the potential detected by the potential detector 171 is equal to or greater than the first threshold $V_{t1}$ but less than the third threshold $V_{t3}$, the control part 172 can determine that there is a malfunction due to a disconnection of the second detection switch 142. In a case where the potential detected by the potential detector 171 is equal to or greater than the third threshold $V_{t3}$ but equal to or less than the second threshold $V_{t2}$, the control part 172 can determine that there is a malfunction due to a disconnection of the first detection switch 132. In this case, the control part 172 can further determine which one of the first and second detection switches 132, 142 has malfunctioned.

As for a malfunction mode besides disconnection, there may be short-circuiting of a detection switch (short-circuit mode). In the short-circuit mode, similar to malfunction due to a disconnection, the control part can determine whether a short-circuit occurs by detecting divided voltage levels. A more detailed status determination can be performed by performing a determination in combination with the detection of other signals such as signals indicating a head-up (open-cover) state.

In the above-described embodiments, mechanical switches are used for the first and second detection switches 132, 142 in the above-described embodiments. However, for example, optical sensors that are switched off when the platen roller 20 is mounted in the predetermined position and switched on when the platen roller 20 is disengaged from the predetermined position may be used.

In the above-described embodiments, the third resistor R21 and the fourth resistor R22 may be combined to be a single resistor. In this case, the combined single resistor is assumed to be a resistor positioned on the ground side.

Next, an example is described with specific values. As illustrated in FIG. 9, the resistance of the first resistor R11 is assumed as 0.75 kΩ, the resistance of the second resistor R12 is assumed as 1.2 kΩ, the resistance of the third resistor R21 is assumed as 0.47 kΩ, the resistance of the fourth resistor R22 is assumed as 1.2 kΩ, and the voltage of the power supply Vcc is assumed as 2.8 V. In this case, as illustrated in FIG. 10, the potential $V_1$ is approximately 1.9 V, the potential $V_2$ is approximately 1.6 V, and the potential $V_3$ is approximately 1.2 V according to the Expressions 1-3.

Accordingly, the first threshold $V_{t1}$ may be set to a voltage that is between 0 V and the potential $V_3$ (approx. 1.2 V), for example, 0.5 V. The second threshold $V_{t2}$ may be set to a voltage that is between the potential $V_2$ (approx. 1.6 V) and the potential $V_1$ (approx. 1.9 V), for example, 1.8 V. The third threshold $V_{t3}$ may be set to a voltage that is between the potential $V_3$ (approx. 1.2 V) and the potential $V_2$ (approx. 1.6 V), for example, 1.4 V.

Thus, if the potential detected by the potential detector 171 is less than the first threshold (0.5 V), the control part 172 can determine that the platen roller 20 is mounted in the predetermined position. Further, if the potential detected by the potential detector 171 is higher than the second threshold (1.8 V), the control part 172 can determine that the platen roller 20 is not mounted in the predetermined position.

Further, if the potential detected by the potential detector 171 is greater than or equal to the first threshold (0.5 V) but less than or equal to the third threshold (1.4 V), the control part 172 can determine that there is a malfunction due to a disconnection of the second detection switch 142. Further, in a case where the potential detected by the potential detector 171 is greater than or equal to the third threshold (1.4 V) but less than or equal to the second threshold (1.8 V), the control part 172 can determine that there is a malfunction due to a disconnection of the first detection switch 132.

Further, the control part 172 may also determine whether there is a malfunction due to short-circuiting of the first detection switch 132 or the second detection switch 142 by using the relationships illustrated in FIGS. 9 and 10. The control part 172 can determine whether the malfunction is due to a disconnection or short-circuiting by considering the detected potential in combination with status detection results from, for example, a head-up (open-cover) sensor.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

The invention claimed is:

1. A printer, comprising:

a platen roller;

a print head for performing printing on a recording paper;

a first detection switch and a second detection switch for detecting a position of the platen roller; and a potential detector;

wherein both of the first and second detection switches are switched off when the platen roller is mounted, and are switched on when the platen roller is not mounted, wherein one terminal of the first detection switch and one terminal of the second detection switch are connected to each other in parallel and grounded via a ground side resistor, wherein a power supply is to be connected to another terminal of the first detection switch and another terminal of the second detection switch, and wherein the potential detector is configured to detect a potential between the one terminals of the first and second detection switches and the ground side resistor.

2. The printer as claimed in claim 1, wherein the ground side resistor includes a first resistor and a second resistor connected in parallel.

3. The printer as claimed in claim 2, wherein the other terminal of the first detection switch is connected to a third resistor, the power supply potential is to be connected to the other terminal of the first detection switch via the third resistor, the other terminal of the second detection switch is connected to a fourth resistor, wherein the power supply is to be connected to the other terminal of the second detection terminal via the fourth resistor, and the third resistor and the fourth resistor have different resistance values.

4. A printer, comprising:

a platen roller;

a print head for performing printing on a recording paper;

a first detection switch for detecting a position of one side of the platen roller;

a second detection switch for detecting a position of another side of the platen roller; and a potential detector;

wherein both of the first and second detection switches are switched off when the platen roller is mounted, and are switched on when the platen roller is not mounted, wherein one terminal of the first detection switch and one terminal of the second detection switch are connected to each other and grounded, wherein another terminal of the first detection switch and another terminal of the second detection switch are connected to each other and to be connected to a power supply via a resistor, wherein the potential detector is configured to detect a potential between the another terminals of the first and second detection switches and the resistor.

5. A method for controlling a printer including a platen roller, a first detection switch for detecting a position of one side of the platen roller which is switched off when the platen roller is mounted and is switched on when the platen roller is not mounted, a second detection switch for detecting a position of another side of the platen roller which is switched off when the platen roller is mounted and is switched on when the platen roller is not mounted, and a potential detector, the method comprising:

detecting a potential at terminals of the first and second detection switches;

determining that the platen roller is mounted when the potential is lower than a first threshold; and determining that the platen roller is not mounted when the potential is higher than a second threshold that is higher than the first threshold.

6. The method as claimed in claim 5, further comprising: determining that one of the first and second detection switches is malfunctioned when the potential is greater than or equal to the first threshold but less than or equal to the second threshold.

7. The method as claimed in claim 5, further comprising:

determining that one of the first and second detection switches is malfunctioned when the potential is greater than or equal to the first threshold but less than a third threshold that is set between the first and second thresholds, and determining that another one of the first and second detection switches is malfunctioned when the potential is less than or equal to the second threshold but greater than or equal to the third threshold.

8. The method as claimed in claim 5, wherein the detecting includes detecting a potential applied to the first detection switch via a first resistor which is connected between the first detection switch and a power source, and a potential applied to the second detection switch via a second resistor which is connected between the second detection switch and the power source.

9. The method as claimed in claim 5, wherein a potential between the terminals of both of the first and second detection switches and a ground resistor is detected.

* * * * *